US007086906B1

(12) United States Patent
Ting

(10) Patent No.: US 7,086,906 B1
(45) Date of Patent: Aug. 8, 2006

(54) STACKED ELECTRICAL CARD CONNECTOR ASSEMBLY

(75) Inventor: Chien Jen Ting, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/322,771

(22) Filed: Dec. 30, 2005

(30) Foreign Application Priority Data

Feb. 25, 2005 (TW) ..... 94203011 U

(51) Int. Cl.
*H01R 24/00* (2006.01)

(52) U.S. Cl. ..... 439/630; 439/541.5

(58) Field of Classification Search ..... 439/630, 439/607, 541.5
See application file for complete search history.

(56) References Cited

U.S. PATENT DOCUMENTS 6,551,132 B1 4/2003 Kuo
6,558,192 B1 * 5/2003 Kuo ..... 439/541.5
6,579,126 B1 * 6/2003 Narumo et al. ..... 439/630
2005/0079766 A1 * 4/2005 Ho et al. ..... 439/630

FOREIGN PATENT DOCUMENTS

CN 2662470 Y 12/2004

* cited by examiner

*Primary Examiner*—Truc Nguyen
(74) *Attorney, Agent, or Firm*—Wei Te Chung

(57) ABSTRACT

A stacked electrical card connector assembly comprises a first connector (1) having a first insulating body (11) and a row of first terminals (12), and a second connector (2) stacked with the first connector (1) and having a second insulating body (21) and a row of second terminals (22). Each first terminal (12) has a first engaging portion (122) for electrically connecting with a card, and a first securing portion (123) extending backwardly from the first engaging portion (122) and out of the first insulating body (11), and each second terminal (22) has a second engaging portion (222) for electrically connecting with a different card and a second securing portion (223) extending backwardly from the second engaging portion (222) and out of the second insulating body (21). The second securing portions (223) have some under the first securing portions (123).

14 Claims, 4 Drawing Sheets

STACKED ELECTRICAL CARD CONNECTOR ASSEMBLY

BACKGROUND OF THE INVENTION

1. Field of the Invention

The present invention generally relates to an electrical card connector assembly, more particularly to an improved electrical card connector assembly for connecting two different electronic cards to a printed circuit board (PCB).

2. Description of Related Art

With the tendency of reducing the size of a computer device, demand has arisen for increasing its data storage capacity at low cost. Generally, electrical cards, such as memory cards, are functional as data storage devices which are electrically connected to the computer device. The electrical cards are portable instruments that are readily inserted into and extracted from electrical card connectors of the computer device. The connectors typically have sockets to receive the electrical cards therein and headers connected to the computer device such that data can be transferred therebetween.

Due to the ever-increasing demand in today's Notebook Personal Computer (Notebook-PC) for high-capacity signal transmission, more electrical card connectors of different kinds are arranged in "dual port" or stacked configurations. Examples of this electrical card connector assembly are disclosed in U.S. Pat. No. 6,551,132 and China Pat. issue No. 2662470Y. The stacked electrical card connector assembly commonly includes a lower card connector, an upper card connector stacking on the lower card connector, and a transition device connecting the two electrical card connectors to a PCB. However, the transition device not only increases the number of components of the electrical card connector assembly and the manufacturing cost of the electrical card connector assembly, but also reduces the quality of the signal transmission from electrical cards to the PCB by the electrical card connectors.

Therefore, the present invention is directed to solving the above problems by providing an improved electrical card connector assembly which can improve the quality of the signal transmission and further reduces the manufacturing cost.

SUMMARY OF THE INVENTION

Accordingly, an objection of the present invention is to provide a stacked electrical card connector assembly which can be used for receiving two different electronic cards therein.

Another object of the present invention is to provide a stacked electrical card connector assembly which can improve the quality of the signal transmission and further reduce the manufacturing cost.

In order to achieve the objection set forth, a stacked electrical card connector assembly in accordance with the present invention comprises a first connector having a first insulating body having a first transverse base, a tongue protruding ahead from a part of the first transverse base, and a slant prominency protruding ahead from the other part of the first transverse base, and a second connector stacked with the first connector having a second insulating body and a row of second terminals. The first connector further has a row of first terminals, each of which has a first engaging portion enchased in the tongue for electrically connecting with a card, and a first securing portion extending backwardly from the first engaging portion and out of the first insulating body. The second connector further has a row of second terminals, each of which has a second engaging portion for electrically connecting with a different card, and a second securing portion extending backwardly from the second engaging portion and out of the second insulating body. Wherein the second securing portions have some under the first securing portions and the others under the slant prominency of the first insulating body.

Other objects, advantages and novel features of the present invention will become more apparent from the following detailed description of the present embodiment when taken in conjunction with the accompanying drawings.

DETAILED DESCRIPTION OF THE INVENTION

Figure 1:
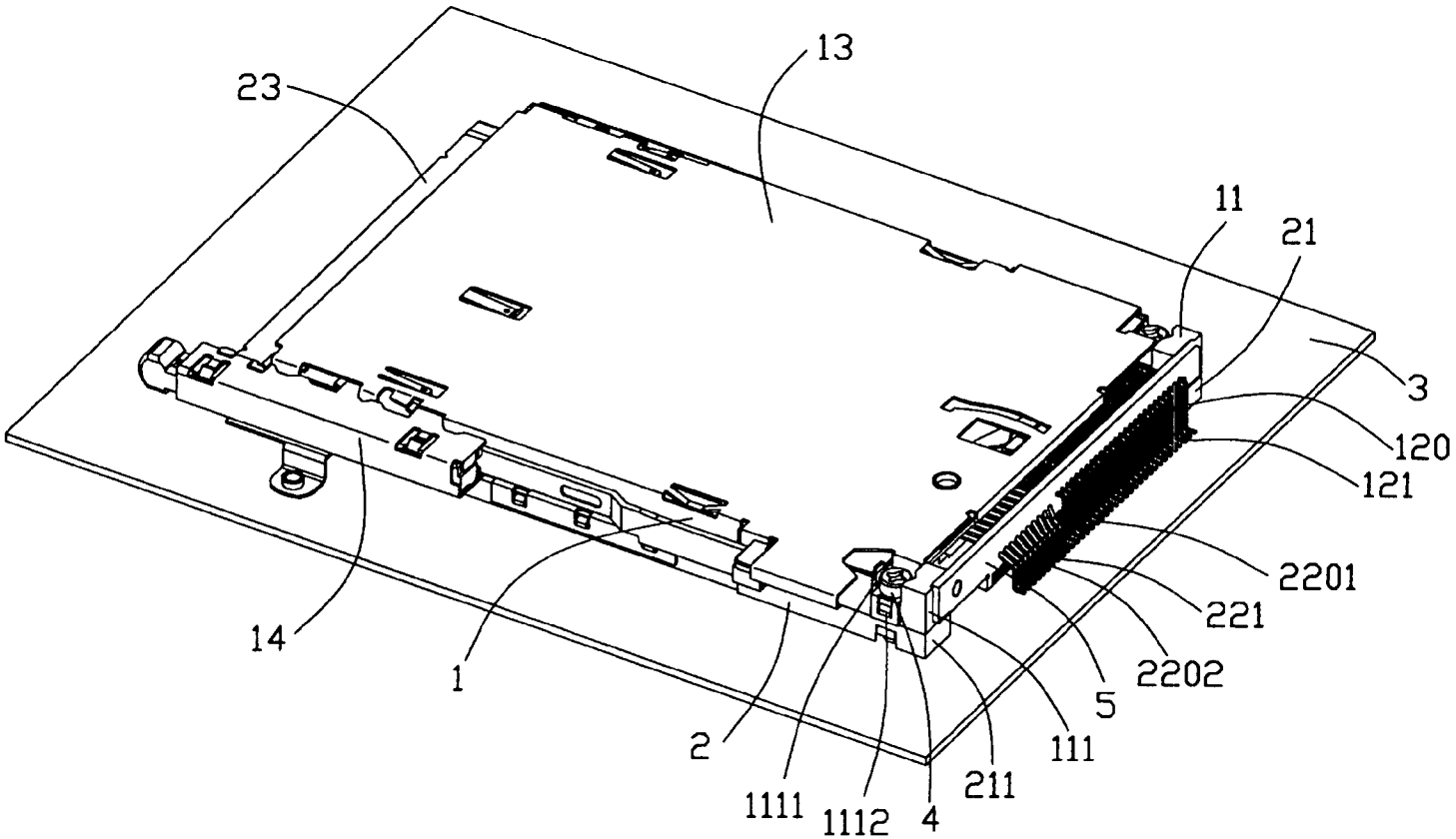
FIG. 1 is an assembled perspective view of a stacked electrical card connector assembly mounted on a printed circuit board according to the present invention.

Reference will now be made to the drawing figures to describe the present invention in detail.

Referring to FIG. 1, a stacked electrical card connector assembly mounted on a printed circuit board (PCB) 3 in accordance with the present invention comprises a second connector 2, a first connector 1 stacking on the second connector 2, and a spacer 5 disposed at the back of the electrical card connector assembly.

Figure 2:
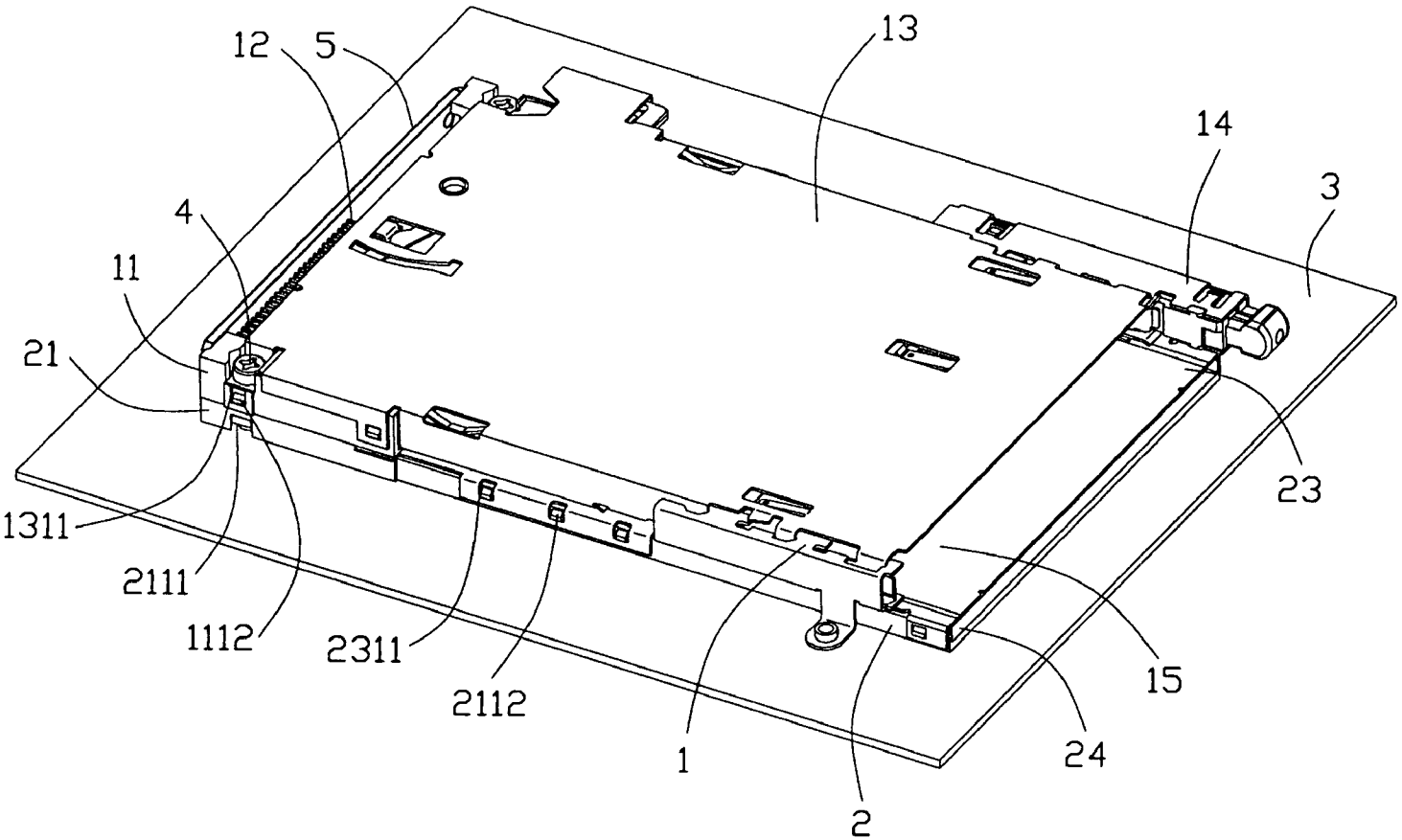
FIG. 2 is an assembled perspective view, seen from another view, of the stacked electrical card connector assembly mounted on the printed circuit board according to the present invention.
Figure 3:
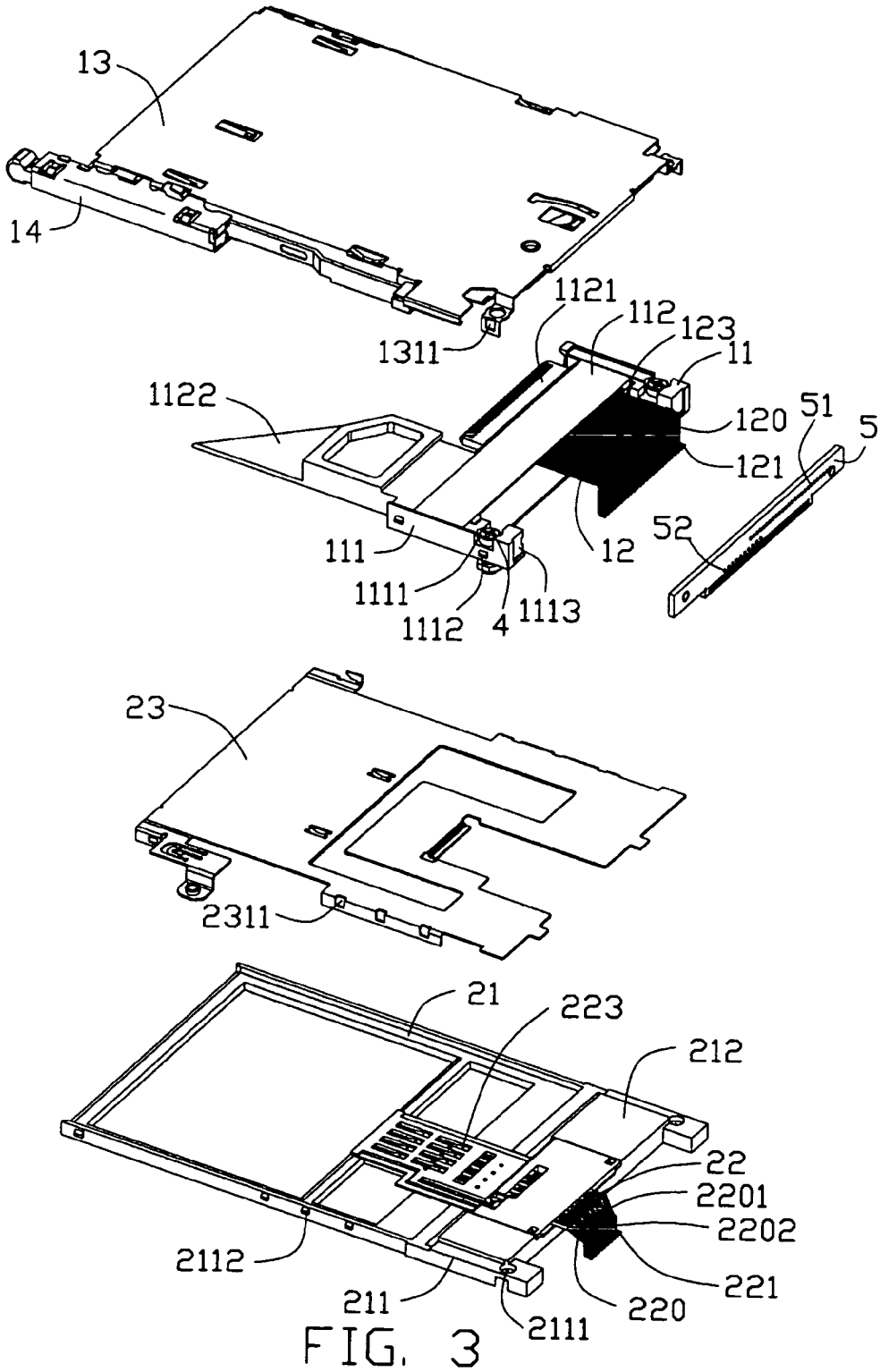
FIG. 3 is an exploded perspective view of the stacked electrical card connector assembly according to the present invention.
Figure 4:
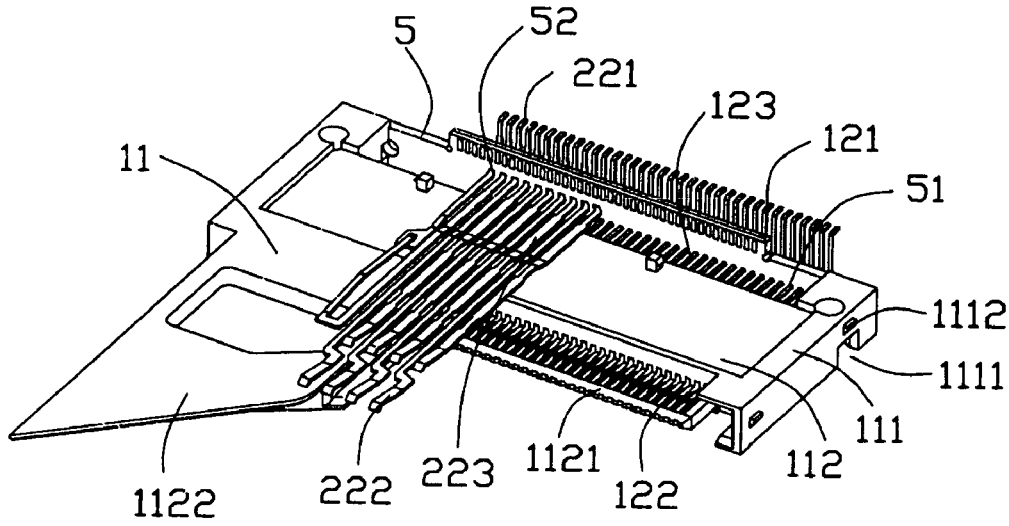
FIG. 4 is an assembled perspective view, seen from a bottom side, of part of the stacked electrical card connector assembly according to the present invention.

Referring to FIGS. 2–4, the first connector 1 is adapted to receive a small card such as an Express Card. At the present embodiment, the first connector 1 receiving an Express Card (not shown) comprises a first insulating body 11, a first shielding 13 covering on a top surface of the first insulating body 11, a first receiving room 15 defined by the first shielding 13 combining with the first insulating body 11 for receiving the Express Card, and a card release mechanism 14 assembled to the first shielding 13. The first insulating body 11 has a pair of first guiding arms 111 and a first transverse base 112 connecting the pair of the first guiding arms 111. The first connector 1 further has a tongue 1121 protruding from a part of the first transverse base 112 to the first receiving room 15 and a slant prominency 1122 protruding from the other part of the first transverse base 112 to the first receiving room 15. The tongue 1121 has a plurality of first terminals 12 retained therein and each first terminal 12 has a first securing portion 123 retained in the first transverse base 112 of the first insulating body 11, a first engaging portion 122 extending ahead from an end of the first securing portion 123 and enchased in the tongue 1121 for electrically engaging with the Express Card, a first connecting portion 120 extending downwardly from the other end of the first securing portion 123, and a first soldering portion 121 extending flatly and backwardly from an end of the first connecting portion 120 for being soldered on the PCB 3. The slant prominency 1122 makes the first receiving room 15 as L-shaped for receiving the Express Card of L-shaped, that is a gap of the Express Card matches the slant prominency 1122 and a shorter side of the Express Card electrically engages with the first engaging portions 122 of the first terminals 12. Otherwise, the first shielding 13 defines an opening 1311 for receiving a projection 1112 provided on the first guiding arm 111 of the upper insulating body 11 therein, thereby the first shielding 13 is secured on the first insulating body 11.

The second connector 2 under the first connector 1 is adapted to receive a small card such as a Smart Card. At the present embodiment, the second connector 2 receiving a Smart Card (not shown) comprises a second insulating body 21 under the first insulating body 11, a second shielding 23 covering on a top surface of the second insulating body 21, a second receiving room 24 defined by the second shielding 23 combining with the second insulating body 21 for receiving the Smart Card, and a plurality of second terminals 22 retained in the second insulating body 21. The second insulating body 21 has a pair of second guiding arms 211 and a second transverse base 212 connecting the pair of the second guiding arms 211. Each second terminal 22 has a second securing portion 223 retained in the second transverse base 212 of the second insulating body 21, a second engaging portion 222 extending ahead from an end of the second securing portion 223 for electrically engaging with the Smart Card, a second connecting portion 220 extending downwardly from the other end of the second securing portion 223, and a second soldering portion 221 extending flatly and backwardly from an end of the second connecting portion 220 for being soldered on the PCB 3. Otherwise, the second shielding 23 defines a plurality of holes 2311 for receiving a plurality of protuberances 2112 provided on the second guiding arm 211 of the second insulating body 21 therein, thereby the second shielding 23 is secured on the second insulating body 21.

The first connector 1 and the second connector 2 are secured together by two bolts 4, each going through a first mounting hole 1111 defined in the first guiding arm 111 of the first insulating body 11 and a second mounting hole 2111 defined in the second guiding arm 211 of the second insulating body 21 and under the first mounting hole 1111. The second securing portions 223 of the second terminals 22 have some under the first securing portions 123 of the first terminals 12 and the others under the slant prominency 1122 of the first insulating body 11.

The spacer 5 is adapted for securing the first and second terminals 12, 22 and has a main body defining a row of first apertures 51 and a row of second apertures 52, and a pair of end portions received in a pair of recesses 1113 defined in two rear ends of the guiding arms 111 of the first connector 1. The row of first and second apertures 51, 52 are both arranged along a longitudinal direction of the spacer 5. Further, the row of first apertures 51 is disposed higher than the row of second apertures 52. In assembly, the first securing portions 123 of the first terminals 12 are extending through the row of first apertures 51 and bending downwardly to form the first connecting portions 120, simultaneously, the second securing portions 213 of the second terminals 22 are extending through the row of second apertures 52 and bending downwardly to form the second connecting portions 220. By pulling the second connecting portions 220 out of the first connecting portions 120, each of the second connecting portions 220 forms two sections that are an inclined section 2201 and a vertical section 2202, as a result, the vertical sections 2202 and the first connecting portions 120 are arranged in a row, and further the soldering portions 221 and the first soldering portions 121 are arranged in a row. In this way, it is not only save space the stacked electrical card connector assembly occupying but also facilitate the first and second soldering portions 121, 221 being soldered on the PCB 3. Lastly, the first and second soldering portions 121, 221 are soldered on the PCB 3 so as to achieve the signal transmission between the electronic cards and the PCB 3 by the stacked electrical card connector.

Accordingly, for the first and second soldering portions of the first and second terminals are directly soldered on the PCB, the signal transmission from the electronic cards to the PCB 3 by the stacked electrical card connector assembly is better than that by a common electrical card connector assembly which has a transition device. Moreover, the manufacturing cost of the stacked electrical card connector assembly is reduced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector assembly for receiving two different electronic cards comprising:

a first connector having a first insulating body having a first transverse base, a tongue protruding ahead from one part of the first transverse base, and a slant prominency protruding ahead from the other part of the first transverse base, the first connector further having a row of first terminals, each first terminal having a first engaging portion enchased in the tongue for electrically connecting with a card, and a first securing portion extending backwardly from the first engaging portion and out of the first insulating body; and a second connector stacked with the first connector having a second insulating body and a row of second terminals, each second terminal having a second engaging portion for electrically connecting with a different card, and a second securing portion extending backwardly from the second engaging portion and out of the second insulating body; wherein the second securing portions of the second terminals have some under the first securing portions of the first terminals and the others under the slant prominency of the first insulating body.

2. The stacked electrical card connector assembly as described in claim 1, wherein the second terminals of the second connector have a smaller number than the first terminals of the first connector.

3. The stacked electrical card connector assembly as described in claim 1, wherein the first connector is receiving an Express Card.

4. The stacked electrical card connector assembly as described in claim 1, wherein the first terminal further has a first connecting portion extending downwardly from a rear end of the first securing portion and a first soldering portion extending backwardly and flatly from the first connecting portion for being soldered on the PCB, and wherein the second terminal further has a second connecting portion extending downwardly from a rear end of the second securing portion and a second soldering portion extending backwardly and flatly from the second connecting portion for being soldered on the PCB.

5. The stacked electrical card connector assembly as described in claim 1, further comprising a spacer securing the first and second terminals.

6. The stacked electrical card connector assembly as described in claim 1, wherein the first and second connector are assembled together by a bolt going through a first mounting hole defined in the first insulating body and a second mounting hole defined in the second insulating body and under the first mounting hole.

7. The stacked electrical card connector assembly as described in claim 1, wherein the first connector further has a first shielding covering on the first insulating body, the first shielding and the first insulating body combining to define a first receiving room for receiving the card.

8. The stacked electrical card connector assembly as described in claim 1, wherein the second connector further has a second shielding covering on the second insulating body, the second shielding and the second insulating body combining to define a second receiving room for receiving the different card.

9. The stacked electrical card connector assembly as described in claim 4, wherein the second connecting portions are pulled out of the first connecting portions and each of the second connecting portions forms an inclined section and a vertical section, wherein the vertical sections and the first connecting portions are arranged in a row.

10. The stacked electrical card connector assembly as described in claim 9, wherein the first and second soldering portions are arranged in a row.

11. The stacked electrical card connector assembly as described in claim 5, wherein the spacer defines a row of first apertures and a row of second apertures, which are both arranged along a longitudinal direction of the spacer.

12. The stacked electrical card connector assembly as described in claim 11, wherein the row of first apertures is disposed higher than the row of second apertures.

13. The stacked electrical card connector assembly as described in claim 5, wherein the spacer further has a pair end portions received in a pair of recesses defined in rear ends of the first insulating body.

14. The stacked electrical card connector assembly as described in claim 6, wherein the first connector further comprises a card release mechanism assembled to the first shielding.

* * * * *